United States Patent [19]

Ebata

[11] Patent Number: 4,766,738

[45] Date of Patent: Aug. 30, 1988

[54] AIR CONDITIONER

[75] Inventor: Yasuhiko Ebata, Otsu, Japan

[73] Assignee: Matsushita Electric Industrial Co., Ltd., Kadoma, Japan

[21] Appl. No.: 114,069

[22] Filed: Oct. 29, 1987

[30] Foreign Application Priority Data

Oct. 30, 1986 [JP] Japan ..... 61-258816
Oct. 30, 1986 [JP] Japan ..... 61-258817

[51] Int. Cl.[4] ..... F25B 47/00

[52] U.S. Cl. ..... 62/280; 62/272; 62/285

[58] Field of Search ..... 62/279, 280, 272, 274, 62/281, 282, 305, 285

[56] References Cited

U.S. PATENT DOCUMENTS 2,721,451 10/1955 Schumacher ..... 62/279
4,424,686 1/1984 Lapeyre et al. ..... 62/279

*Primary Examiner*—Henry A. Bennet
*Attorney, Agent, or Firm*—Wenderoth, Lind & Ponack

[57] ABSTRACT

In a unitary type air conditioner which includes a main body constituted by an outer casing formed into a box-like configuration, a base plate accommodated in the outer casing and a bulkhead provided on the base plate so as to partition the interior into an indoor side and an outdoor side, an evaporator, a blower, etc. provided at the indoor side, a condenser, a propeller fan, a compressor, etc., disposed at the outdoor side respectively, with a groove formed on the base plate for guiding drain water produced by the evaporator under the condenser, and a slinger ring provided for sprinkling the drain water onto the condenser, a cooling medium outlet pipe for the condenser is immersed in the condensed water in the groove for the improvement of condensing capacity and prevention of dew formation on the base plate by the drain water.

7 Claims, 3 Drawing Sheets

AIR CONDITIONER

BACKGROUND OF THE INVENTION

The present invention generally relates to an air conditioning system and more particularly, to an air conditioner of a unitary or integral type in which condensing capacity in a refrigeration cycle is improved by immersing a cooling medium outlet pipe of an outdoor heat-exchanger or condenser in condensed water at an outlet side of a water discharge port for discharging water from an indoor side.

Conventionally, the unitary type air conditioner of the above described type is constructed, for example, as shown in FIG. 5.

More specifically, the known unitary type air conditioner 101 in FIG. 5 generally includes a base plate 102, a bulkhead 103 provided on said base plate 102 for dividing the interior into an indoor side and an outdoor side, and an outer casing 104 for an outer cladding, etc., which constitutes its main body. At the indoor side, there are mounted on the base plate 102, an evaporator 105 which constitutes the known refrigerating cycle and a water receiving pan 106, and a sirocco fan 108 driven by a fan motor 107 for directing air flow toward the evaporator 105. Meanwhile, at the outdoor side, there are provided a condenser 109 located at the back face side, the fan motor 107 referred to above, a propeller fan 11 provided at one end of a driving shaft of said fan motor 107 for directing air flow toward the condenser 109, a slinger ring 110 provided on said propeller fan 111, and a compressor 112 as shown. To said compressor 112, the condenser 109 and the evaporator 105, etc. are connected through pipings, thereby constituting a known refrigerating cycle.

Thus, by operating said compressor 112 and fan motor 107, the refrigerating cycle is caused to function, with air streams being produced at the indoor side and outdoor side as shown by arrows A. As a result, the evaporator 105 effects the cooling function at the indoor side, during which period, particles of drain water adhere to the evaporator 105. Such drain water particles grow as time elapses so as to flow down onto the water receiving pan 106 in the form of water drops, and then, flow into a drain water flow passage 114 of the base plate 102 through a drain water outlet 113 provided in the vicinity of the bulkhead 103. This drain water flow passage 114 extends up to a portion under the slinger ring 110 for the propeller fan 111 through the lower portion of an air guider 115, and the drain water referred to above is led to the portion under the slinger ring 110. Thus, the drain water is picked up by the slinger ring 110, and adheres to the condenser 109 by the action of its centrifugal force together with the action of the air stream so as to be evaporated by the heat of the evaporator.

In the conventional arrangement as described so far, however, there has been such a disadvantage that, when the cold drain water flows out into the drain water flow passage 114 of the base plate 102 through the drain water outlet 113 of the water receiving pan 106, the base plate 102 is cooled, an thus, dew is formed on the under surface of the drain water flow passage 114 of the base plate 102.

Particularly, when the propeller fan 111 is arranged to rotate in a direction in which air pressure is applied onto the drain water flow passage 114 as indicated by the arrows B (i.e. when the propeller fan 111 is rotated counterclockwise as observed from the rear face side), the drain water flowing out into the drain water flow passage 114 through the drain water outlet 113 of the water receiving pan 106 is pushed back by the wind pressure, and therefore, the very cold drain water immediately after flowing out from the drain water outlet 113 stays stagnant without movement, thereby strongly cooling the base plate 102 locally for giving rise to a conspicuous dew formation thereat.

The dew formation as described above invites such problems that, it not only wets wall or window portions where the unitary type air conditioner is mounted to spoil the appearance, but causes corrosion when materials for the wall and window portions are of lumber.

SUMMARY OF THE INVENTION

Accordingly, an essential object of the present invention is to provide a unitary type air conditioner which is capable of improving condensing capacity in a refrigerating cycle by immersing a cooling medium outlet pipe of an outdoor heat exchanger or condenser, in condensed water at an outlet side of a water discharge port for discharging water from an indoor side.

Another important object of the present invention is to provide an air conditioner of the above described type in which heat-exchange with respect to the condensed water is effected by immersing the cooling medium outlet pipe of the outdoor heat exchanger or condenser in the condensed water at the outlet side of the water discharge port so as to raise temperature of the condensed water, thereby making it difficult to form dew on a base plate.

A further object of the present invention is to provide an air conditioner of the above described type in which a groove portion for guiding the condensed water into the outdoor heat exchanger is formed to be inclined from the water discharge port toward the side of an outdoor fan so as to smoothly guide the condensed water towards the outdoor fan side.

A still further object of the present invention is to provide an air conditioner of the above described type in which deriving of the condensed water is arranged to be effected more smoothly through reduction of influence due to blowing pressure of the outdoor propeller fan by arranging the groove portion to extend in a direction opposite to the rotational direction of the outdoor propeller fan.

Still another object of the present invention is to provide an air conditioner of the above described type in which an opening is formed at an intersection between an outdoor air guider and the groove portion so as to achieve a still more smooth guiding of the condensed water.

In accomplishing these and other objects, according to one preferred embodiment of the present invention, there is provided an air conditioner which includes an air conditioner main body constituted by an outer casing formed into a box-like configuration, a base plate accommodated in said outer casing and a bulkhead provided on said base plate so as to partition the interior into an indoor side and an outdoor side, outdoor side air intake port and air blast port provided at the outdoor side of said outer casing, indoor side air intake port and air blast port provided at the indoor side of said outer casing, an outdoor heat-exchanger placed on said base plate and positioned to confront said outdoor side air intake port, an outdoor side air guider constituting an outdoor side wind circuit accommodating said outdoor side heat-exchanger, an outdoor fan provided in said outdoor side wind circuit for producing air current so that air introduced from said outdoor side air intake port and passing through the outdoor heat exchanger flows into said outdoor side air blast port, a slinger ring provided on said outdoor fan, a fan motor for driving said outdoor fan, a compressor connected at one end of said outdoor heat exchanger and a pressure reducer connected to the other end of said outdoor heat-exchanger which are provided at the outdoor side of said air conditioner main body, an indoor heat-exchanger positioned to confront said indoor side air intake port and connected, at its opposite ends, respectively to said compressor and said pressure reducer, an indoor air guider constituting an indoor side wind circuit accommodating said indoor heat-exchanger, and an indoor fan provided in said indoor side wind circuit for producing air current so that air introduced from said indoor side intake port and passing through said indoor heat-exchanger flows into said indoor side air blast port and a water receiving pan for receiving condensed water dropping from said indoor heat-exchanger which are provided at the indoor side of said air conditioner main body, a water discharge port provided at the side close to said outer casing in said water receiving pan for discharging water collected in said pan onto said base plate, and further, a cooling medium outlet pipe in said outdoor heat-exchanger provided at the outlet side of said water discharge port to extend over said base plate.

By the arrangement of the present invention as described above, an improved air conditioner with an improved condensing capacity has been advantageously presented through simple construction.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
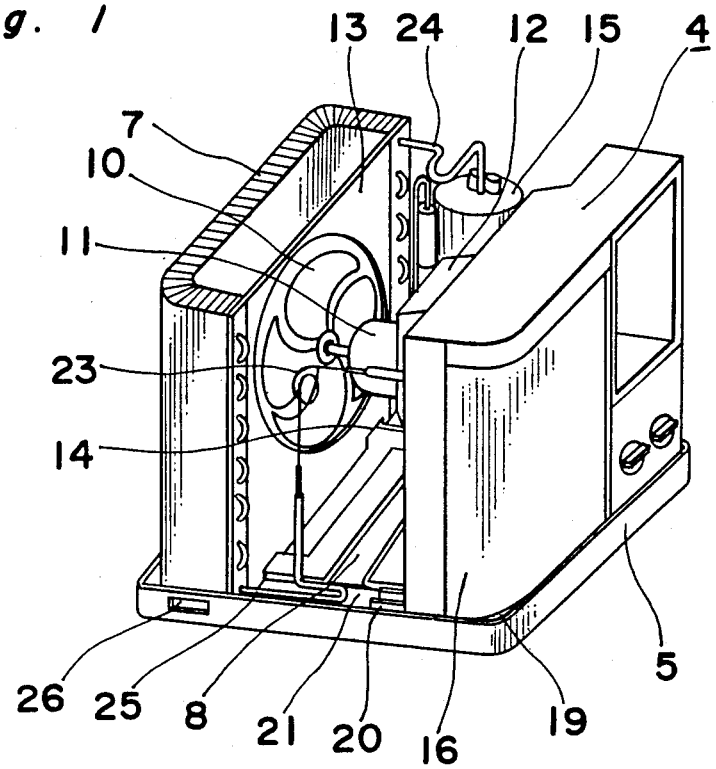
FIG. 1 is a perspective view showing an inner unit for a unitary type air conditioner according to one preferred embodiment of the present invention, with an outer casing being removed for clarity.

Before the description of the present invention proceeds, it is to be noted that like parts are designated by like reference numerals throughout the accompanying drawings.

Figure 2:
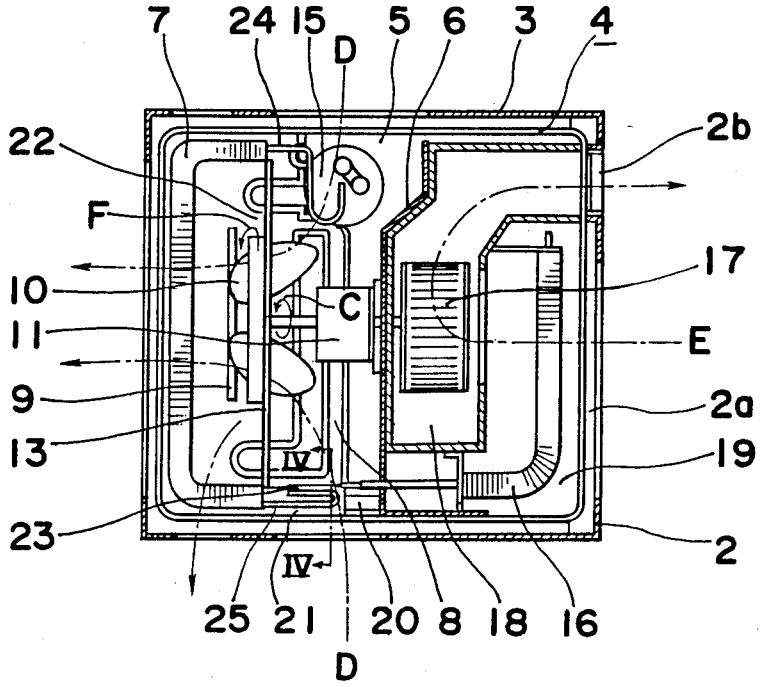
FIG. 2 is a top plan sectional view of the air conditioner of FIG. 1 as enclosed in the outer casing.
Figure 3:
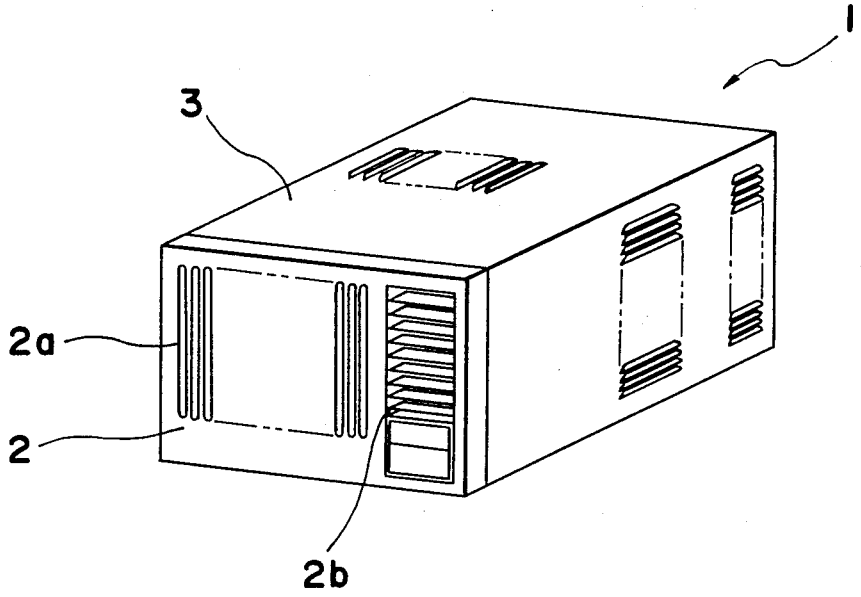
FIG. 3 is a perspective view of the air conditioner of FIG. 2 as observed from its front grille side.
Figure 4:
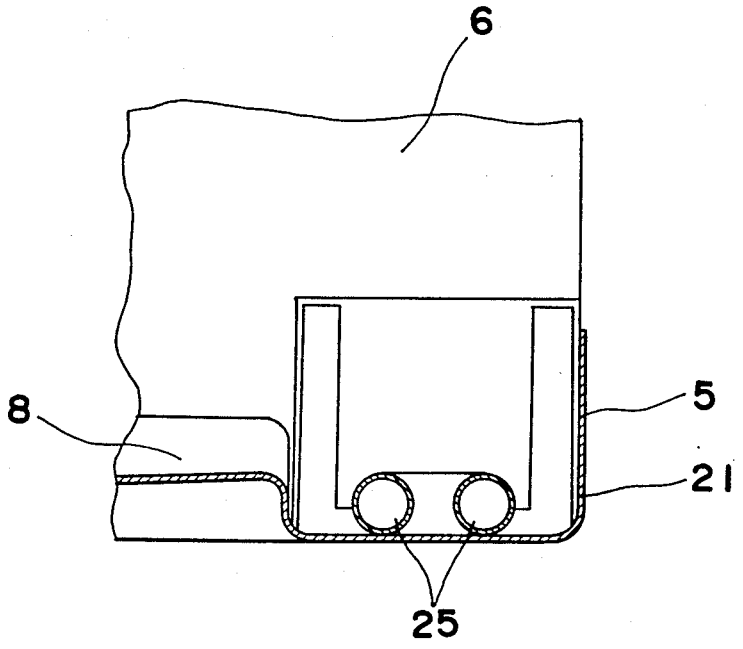
FIG. 4 is a fragmentary cross section, on an enlarged scale, taken along the line IV—IV in FIG. 2.
Figure 5:
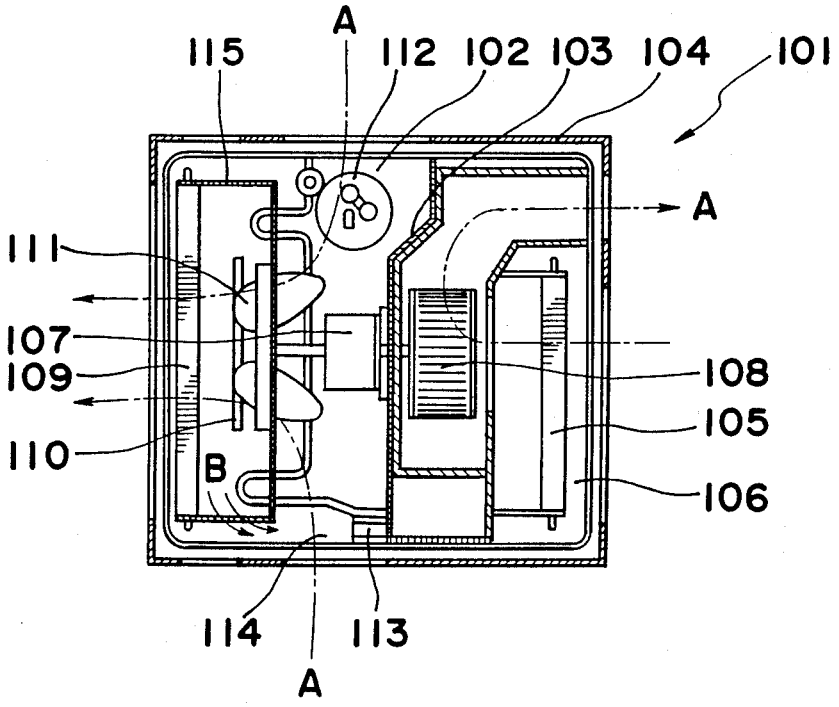
Fig. 5 PRIOR ART
FIG. 5 is a top plan sectional view of a conventional unitary type air conditioner (already referred to).

Referring now to the drawings, there is shown in FIG. 3 a unitary type air conditioner according to one preferred embodiment of the present invention, which generally includes a main body 1 constituted by an outer casing 3, a front grille 2 provided at a front side of the outer casing 3 and having an air intake port 2*a* and an air blast port 2*b*, and an inner unit 4 as shown in FIG. 1 releasably accommodated within said outer casing 3 for insertion and withdrawal. The inner unit 4 referred to above includes a base plate 5 and a bulkhead 6 extending upwardly from the base plate 5 so as to divide the space above said base plate into an outdoor side and an indoor side (FIG. 2). At the outdoor side of the inner unit 4, there are provided a condenser (or outdoor heat exchanger) 7 having a generally U-shaped cross section whose open face side is directed to confront said bulkhead 6, a groove 8 formed on the base plate 5 to extend from a portion in the vicinity of the mounted portion of said bulkhead 6 up to a position close to the condenser 7, a water sump portion 22 located at the lower portion of the condenser 7 and continuous to the groove 8, a fan motor 11, a fan motor mounting plate 12 for securing the fan motor 11 on the bulkhead 6, an outdoor air guider 13 provided on the open face side of the condenser 7 having the U-shaped cross section, a propeller fan 10 located in the outdoor air guider 13 and mounted on one end of a driving shaft of said fan motor, a slinger ring 9 attached to the propeller fan 10 for picking up the condensed water (drain water) within said water sump 22, a compressor 15, and pipings 24 and 25 which connect the compressor 15, condenser 7 and a capillary tube 23 so as to constitute a known refrigerating cycle. Meanwhile, as shown in FIG. 4, at one end of the groove 8 formed in the base plate 5, there is provided an accomodating portion 21 for accommodating, in contact therewith, the piping 25 which serves as a cooling medium outlet of said condenser 7. At an intersection between the groove 8 and the outdoor air guider 13, there is provided an opening 14 in said air guider.

In the above construction, the groove 8, water sump portion 22 and accommodating portion 21 are formed by subjecting the base plate 5 of a metallic material to press work. Particularly, the groove 8 is formed with an inclination so that the side for the accommodating portion 21 is higher so as to be lower toward the side for the water sump 22. Moreover, notches or openings 26 are formed at the opposite sides of the base plate 5 so as to serve as overflow ports upon entry of much rain water or the like.

On the other hand, at the indoor side of the inner unit 4, there are mounted an evaporator (or indoor heat exchanger) 16 having a generally L-shaped cross section and directed to confront the air intake port 2*a* of the front grille 2, a casing 18 including said evaporator 16 and communicated with the air intake port 2*a* and air blast port 2*b*, a sirocco fan 17 provided in the casing 18 and mounted on the other end of the driving shaft for the fan motor 11, a water receiving pan 19 disposed under the evaporator 16 so as to collect the drain water produced by the evaporator 16, and a drain water discharge port 20 extending from one end of said water receiving pan 19 to the accommodating portion 21 at the outdoor side through the bulkhead 6, with the evaporator 16 being connected to the capillary tube 23 and the compressor 15 through pipings.

In the above construction, upon operation of the compressor 15 and the fan motor 11, the cooling medium is circulated from the compressor 15, through the condenser 7, capillary tube 23, evaporator 16, and again, to the compressor 15 for refrigerating cycle, with heat radiation being effected by the condenser 7 and endothermic reaction taking place at the evaporator 16.

Meanwhile, ventilation is effected as shown by the arrows D at the outdoor side, and as indicated by the arrows E, at the indoor side.

Thus, as time elapses, drain water particles adhere to the evaporator 16 so as to fall onto the water receiving pan 19 in the form of water drops soon.

When a large amount of drain water is collected in the water receiving pan 19, such drain water flows out from said pan 19 onto the base plate 5 at the outdoor side through the drain water discharge port 20 formed at the lower portion of the bulkhead 6. The drain water thus flowing out is first introduced into the accommodating portion 21 so as to cool the piping 25 at the cooling medium outlet side of the condenser 7, and is evaporated by the heat exchanging action thereof. In the case where the drain water thus produced is increased in its amount to such an extent that it can not be fully evaporated at said accommodating portion 21, said drain water flows into the water sump portion 22 through the groove 8. When the drain water reaches a certain level in the water sump portion 22, it is picked up by the slinger ring 9 and sprinkled over the condenser 7 for heat-exchanging therewith also, and evaporation is expedited for efficient processing of the drain water.

Meanwhile, in the space where the water sump portion 22 is located, i.e., the space surrounded by the condenser 7 and the outdoor air guider 13, since wind pressure is excessively varied by the propeller fan 10, the drain water which can not be fully evaporated is repeatedly picked up by the slinger ring 9 as it is circulated within the condenser 7 having the U-shaped cross section, so as to be sprinkled over the condenser 7 for evaporation.

In the state as described above, the drain water passing through the groove 8 flows smoothly, owing to the construction that the groove 8 is inclined toward the side of the water sump portion 22.

As shown in FIG. 2, when the propeller fan 10 is rotated in a direction indicated by an arrow C, wind pressure is applied in a direction of an arrow F, i.e., in the rotating direction of the propeller fan 10. By the positioning of the opening 14 at an upstream side in the direction of an arrow F under the above state, air at the side of the compressor 15 is to be taken in through said opening 14.

Accordingly, the sucking action from the opening 14 is in the same direction as that of the drain water flowing through the groove 8, and consequently, the drain water is accelerated in its speed for smooth flowing, without being stagnant on the way.

Furthermore, in the case where a large amount of water is collected in the water sump 22 due to an excessively large amount of drain water produced or due to entry of much rain water, etc., such excessive drain water or rain water is discharged through the notches 26 formed in the side walls of the base plate 5. Since the notches 26 are provided in positions considerably spaced from the indoor side, there is no possibility that the discharged water is splashed onto the wall surfaces of the building or the like in which which the air conditioner is installed.

As is clear from the foregoing description, in the air conditioner according to the present invention, since the groove 8 for guiding the drain water from the water receiving pan 19 of the evaporator 16 into the water sump portion 22 is formed in the metallic base plate 5 by press work in such a manner that it is higher at the side of the water receiving pan 19 so as to be inclined toward the water sump portion 22, the drain water smoothly flows into said water sump portion. As a result, the base plate 5 is locally cooled by the stagnant drain water at a low temperature, and thus, the undesirable local dew formation at the reverse surface of the base plate may be advantageously suppressed. Accordingly, there is no possibility that the formed dew which has grown into water drops may flow down over wall surfaces of the building to spoil such wall surfaces.

Meanwhile, by subjecting the drain water from the water receiving pan 19 to the heat-exchange with respect to the outlet side piping at a high temperature of the condenser 7, improvment of the condensation capacity may be intended, whereby heat of the drain water is utilized for the improvement of the refrigerating cycle (i.e., cooling capacity) so as to derive still higher cooling efficiency.

The heat-exchanging function as referred to above serves to raise the low temperature of the drain water, and consequently, cooling of the base plate 5 by the drain water is alleviated so as to suppress the undesirable dew formation on the reverse surface of the base plate 5.

Furthermore, by extending the groove 8 in the direction opposite to the rotational direction of the propeller fan 10, the wind pressure by the propeller fan 10 does not function in the direction to obstruct the flow of the drain water, and thus, it is made possible to provide a still more smooth flow of the drain water, whereby local cooling of the base plate 5 by the stagnant drain water can be further reduced.

Additionally, by forming the opening 14 at the intersection between the outdoor air guider 13 and the groove 8, an air stream flowing into the water sump portion 22 from the groove 8 is formed at the opening 14 for accelerating the flowing speed of the drain water, thereby to provide a still more smooth flow of the drain water.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An air conditioner which comprises an air conditioner main body constituted by an outer casing (3) formed into a box-like configuration, a base plate accommodated in said outer casing and a bulkhead provided on said base plate so as to partition the interior into an indoor side and an outdoor side, outdoor side air intake port and air blast port provided at the outdoor side of said outer casing, indoor side air intake port and air blast port provided at the indoor side of said outer casing, an outdoor heat-exchanger placed on said base plate and positioned to confront said outdoor side air intake port, an outdoor side air guider constituting an outdoor side wind circuit accommodating said outdoor side heat-exchanger, an outdoor fan provided in said outdoor side wind circuit for producing air current so that air introduced from said outdoor side air intake port and passing through the outdoor heat exchanger flows into said outdoor side air blast port, a slinger ring provided on said outdoor fan, a fan motor for driving said outdoor fan, a compressor connected at one end of said outdoor heat exchanger and a pressure reducer connected to the other end of said outdoor heat-exchanger which are provided at the outdoor side of said air conditioner main body, an indoor heat-exchanger positioned to confront said indoor side air intake port and connected, at its opposite ends, respectively to said compressor and said pressure reducer, an indoor air guider constituting said indoor heat-exchanger, and an indoor fan provided in said indoor side wind circuit for producing air current so that air introduced from said indoor side intake port and passing through said indoor heat-exchanger flows into said indoor side air blast port and a water receiving pan for receiving condensed water dropping from said indoor heat-exchanger which are provided at the indoor side of said air conditioner main body, a water discharge port provided at the side close to said outer casing in said water receiving pan for discharging water collected in said pan onto said base plate, and further, a cooling medium outlet pipe in said outdoor heat-exchanger provided at the outlet side of said water discharge port to extend over said base plate.

2. An air conditioner as claimed in claim 1, wherein said base plate is formed, by press work, with a water sump provided under said outdoor fan for collecting the condensed water sprinkled onto said outdoor heat-exchanger by the slinger ring, and a groove portion for leading the condensed water from the water discharge port into said water sump respectively, said groove portion being altered in its drawing depth so that its side at the water discharge port is higher than the side thereof at the water sump.

3. An air conditioner as claimed in claim 2, wherein said outdoor fan is of a propeller fan, with said groove portion being adapted to extend in a direction opposite to a rotational direction of said propeller fan.

4. An air conditioner as claimed in claim 3, wherein an opening is formed at an intersection between said outdoor air guider and said groove portion.

5. An air conditioner which comprises an air conditioner main body constituted by an outer casing formed into a box-like configuration, a base plate accommodated in said outer casing and a bulkhead provided on said base plate so as to partition the interior into an indoor side and an outdoor side, outdoor side air intake port and air blast port provided at the outdoor side of said outer casing, indoor side air intake port and air blast port provided at the indoor side of said outer casing, an outdoor heat-exchanger placed on said base plate and positioned to confront said outdoor side air intake port, an outdoor side air guider constituting an outdoor side wind circuit accomodating said outdoor side heat-exchanger, an outdoor fan provided in said outdoor side wind circuit for producing air current so that air introduced from said outdoor side air intake port and passing through the outdoor heat exchanger flows into said outdoor side air blast port, a slinger ring provided on said outdoor fan, a fan motor for driving said outdoor fan, a compressor connected at one end of said outdoor heat exchanger and a pressure reducer connected to the other end of said outdoor heat-exchanger which are provided at the outdoor side of said air conditioner main body, an indoor heat-exchanger positioned to confront said indoor side air intake port and connected, at its opposite ends, respectively to said compressor and said pressure reducer, an indoor air guider constituting said indoor heat-exchanger, and an indoor fan provided in said indoor side wind circuit for producing air current so that air introduced from said indoor side intake port and passing through said indoor heat-exchanger flows into said indoor side air blast port and a water receiving pan for receiving condensed water dropping from said indoor heat-exchanger which are provided at the indoor side of said air conditioner main body, a water discharge port provided at the side close to said outer casing in said water receiving pan for discharging water collected in said pan onto said base plate, and further, a cooling medium outlet pipe in said outdoor heat-exchanger provided at the outlet side of said water discharge port to extend over said base plate, said base plate being formed, by press work, with a water sump provided under said outdoor fan for collecting the condensed water sprinkled onto said outdoor heat-exchanger by the slinger ring, and a groove portion for leading the condensed water from the water discharge port into said water sump respectively, said outdoor fan being of a propeller fan, with said groove portion being adapted to extend in a direction opposite to a rotational direction of said propeller fan.

6. An air conditioner as claimed in claim 5, wherein an opening is formed at an intersection between said outdoor air guider and said groove portion.

7. An air conditioner which comprises an air conditioner main body constituted by an outer casing formed into a box-like configuration, a base plate accommodated in said outer casing and a bulkhead provided on said base plate so as to partition the interior into an indoor side and an outdoor side, outdoor side air intake port and air blast port provided at the outdoor side of said outer casing, indoor side air intake port and air blast port provided at the indoor side of said outer casing, an outdoor heat-exchanger placed on said base plate and positioned to confront said outdoor side air intake port, an outdoor side air guider constituting an outdoor side wind circuit accommodating said outdoor side heat-exchanger, an outdoor fan provided in said outdoor side wind circuit for producing air current so that air introduced from said outdoor side air intake port and passing through the outdoor heat exchanger flows into said outdoor side air blast port, a slinger ring provided on said outdoor fan, a fan motor for driving said outdoor fan, a compressor connected at one end of said outdoor heat exchanger and a pressure reducer connected to the other end of said outdoor heat-exchanger which are provided at the outdoor side of said air conditioner main body, an indoor heat-exchanger positioned to confront said indoor side air intake port and connected, at its opposite ends, respectively to said compressor and said pressure reducer, an indoor air guider constituting said indoor heat-exchanger, and an indoor fan provided in said indoor side wind circuit for producing air current so that air introduced from said indoor side intake port and passing through said indoor heat-exchanger flows into said indoor side air blast port and a water receiving pan for receiving condensed water dropping from said indoor heat-exchanger which are provided at the indoor side of said air conditioner main body, a water discharge port provided at the side close to said outer casing in said water receiving pan for discharging water collected in said pan onto said base plate, said base plate being formed, by press work, with a water sump provided under said outdoor fan for collecting the condensed water sprinkled onto said outdoor heat-exchanger by the slinger ring, and a groove portion for leading the condensed water from the water discharge port into said water sump respectively, said groove portion being altered in its drawing depth so that its side at the water discharge port is higher than the side thereof at the water sump, and further, a cooling medium outlet pipe in said outdoor heat-exchanger provided at the outlet side of said water discharge port to extend over said based plate, said outdoor fan being of a propeller fan, with said groove portion being adapted to extend in a direction opposite to a rotational direction of said propeller fan, with an opening being formed at an intersection between said outdoor air guider and said groove portion.

* * * * *